US009896833B2

(12) United States Patent
Moody et al.

(10) Patent No.: US 9,896,833 B2
(45) Date of Patent: Feb. 20, 2018

(54) FLOW CONTROL SYSTEM

(71) Applicants: Jonathan Moody, Hudson, FL (US); Raymond Bellas, New Port Richey, FL (US)

(72) Inventors: Jonathan Moody, Hudson, FL (US); Raymond Bellas, New Port Richey, FL (US)

( * ) Notice: Subject to any disclaimer, the term of this patent is extended or adjusted under 35 U.S.C. 154(b) by 0 days.

(21) Appl. No.: 15/135,506

(22) Filed: Apr. 21, 2016

(65) Prior Publication Data

US 2017/0306607 A1 Oct. 26, 2017

(51) Int. Cl.
*E03F 5/10* (2006.01)

(52) U.S. Cl.
CPC ..... *E03F 5/107* (2013.01); *E03F 5/101* (2013.01)

(58) Field of Classification Search
CPC ..... E03F 5/107
USPC ..... 405/80, 92, 96, 97; 137/578
See application file for complete search history.

(56) References Cited

U.S. PATENT DOCUMENTS 7,186,058 B2 * 3/2007 Schluter ..... E03F 5/107 405/39

FOREIGN PATENT DOCUMENTS

JP 63142113 * 6/1988

* cited by examiner

*Primary Examiner* — Sean D Andrish
(74) *Attorney, Agent, or Firm* — Justin Luby

(57) ABSTRACT

An application for a flow control system includes a vertically oriented expanding conduit, positioned within the interior of a container which is fluidly interfaced to a downstream drainage system. The lower end of the expanding conduit is in fluid communication with an upstream reservoir through a closed conduit. A means to restrain the expanding conduit from lateral movement is provided and the means is in fluid communication with the interior of the container. The distal, upper end of the expanding conduit is capped and at least one fluid passageway opens through the cap from the interior of the expanding conduit. As the fluid pressure rises in the expanding conduit in response to an increase in the fluid level in the upstream reservoir, the fluid passageway through the capped, upper end of the expanding conduit rises to prescribed level and the release rate of fluid into the downstream drainage system is maintained at a prescribed rate or range of rates as the fluid level continues to rise.

36 Claims, 7 Drawing Sheets

FLOW CONTROL SYSTEM

CROSS-REFERENCE TO RELATED APPLICATIONS

Not Applicable

FIELD OF THE INVENTION

The disclosure relates to the field of flow control systems and more particularly to a flow control system for detention ponds, surge tanks, reservoirs and other applications wherein upstream fluid levels vary in response to varying rates of inflow.

BACKGROUND

There are many fluid handling systems wherein the upstream fluid levels or pressures vary and it is desirable to passively control the rate of release with a flow control system which requires no human intervention or external energy source to activate. Examples of these systems include storm water detention ponds, storage reservoirs, holding tanks, surge tanks and the like. In general, these systems receive varying rates of fluid flow, which at times may exceed the desirable release rate or range of release rates as the case may be. When the inflow rate to these systems exceeds the release rate, a volume of fluid is stored and in response, the upstream fluid level rises. Conversely, when the release rate exceeds the inflow rate, the stored volume of fluid is released and the upstream fluid level falls.

Historically, the release rate from these type systems has been passively controlled with weirs and orifices, both of which produce flow rates which increase exponentially as the upstream fluid level rises. When inflow rates dramatically exceed the desirable outflow rate, this characteristic often results in a system wherein a large volume of storage is required to control the fluid at or below the level which does not produce a release in excess of the desired rate or range of rates. Since the costs of land acquisition, engineering, construction and transportation associated with creating large volumes of storage can be quite expensive, it is advantageous to design these systems with as little volume as possible. This objective is accomplished when the system design accommodates release at the desired rate for the maximum amount of time, as is depicted in FIG. 3 of U.S. Pat. No. 7,052,206 to Mastromonaco.

The prior art is replete with a variety of possible solutions to this design problem. One such example is disclosed in U.S. Pat. No. 7,125,200 to Fulton wherein he describes a flow control device for a holding pond consisting of a buoyant flow control module housing an orifice within an interior chamber that is maintained at a predetermined depth below the water surface. Fluid discharged through the orifice is conveyed to the outlet through a bellow, an accordion like conduit which facilitates vertical motion of the buoyant flow control module. Another such example is disclosed in U.S. Pat. No. 6,997,644 to Fleeger, wherein he describes a floating weir assembly for incorporation into a detention vessel. The floating weir assembly is supported by a buoyant means which maintains the weir opening at a predetermined depth below the water surface. In order to facilitate vertical motion, fluid passing over the weir is conveyed to the outlet by means of a hose which has greater capacity than the discharge produced by the weir. In U.S. Pat. No. 6,474,361 to Poppe a floating weir assembly is described which is ballasted with a flowable medium such as liquid or a solid particulate matter like sand to maintain the submergence of the assembly at predetermined depth below the fluid surface. Similar to Fleeger's disclosure, the preferred means to convey discharge to the outlet is a flexible hose. In U.S. Pat. No. 7,762,741 to Moody, co-inventor of the present disclosure, a flow control system for incorporation into a detention pond or surge tank is described whereby a moving riser, made buoyant and supported by at least one float is suspended within a stationary riser such that the opening to the moving riser is maintained at a fixed and predetermined depth below the fluid surface. Discharge through and around the moving riser is conveyed to the outlet through the stationary riser. Each of the foregoing examples utilize buoyancy to maintain the opening of a fluid passage at a fixed and predetermined depth below the upstream fluid surface.

Other proposed solutions have used buoyancy to effect changes in the area of a fluid passage. One such example is disclosed in U.S. Pat. No. 8,043,026 to Moody, co-inventor of the present disclosure, wherein a flow control system for incorporation into a detention pond or surge tank is described. The flow control system comprises a tapered plunger, suspended from at least one float, and the tapered plunger is located within and at the bottom edge of a vertically oriented tube which is fixed in a stationary position. Fluid from the upstream reservoir enters the tube from the upper end and its flow is restricted at the bottom end. As the upstream fluid level changes, at least one float moves the tapered plunger such that the area of the fluid passage between the inside, bottom edge of the stationary tube and the outside edge of the tapered plunger is reduced when the fluid level rises and conversely, increases as the fluid level falls. In the preferred embodiment, the taper of the plunger is formed such that the change in the area of the fluid passage maintains the flow rate at a constant rate.

Other solutions have sought to change the area of the fluid passage by the use of pressure rather than buoyancy. In U.S. Pat. No. 5,887,613 to Steinhardt a flow control system is disclosed whereby fluid pressure acts against a "form-changeable member" with a hollow interior which is connected to a pressure different from the pressure outside of the "form-changeable member". The "form-changeable member" is biased with a spring against a bracket which supports a gate over the fluid passage. As the fluid level in the upstream reservoir rises, the pressure acting on the "form-changeable member" in turn rises, acting against the spring and reducing the area of the fluid passage. In the preferred embodiment, the bias of the spring and the geometry of the gate are designed such that the flow rate through the fluid passage remains constant as the upstream fluid levels both rise and fall.

Although all of these disclosures are passively operated and can theoretically control the rate of fluid release at a constant or nearly constant rate, they all rely on floats, springs and/or flexible conduits operating in conditions wherein the pressure on the outside of the conduit is higher than the pressure inside the conduit. These features have proven to be problematic for a number of reasons. Floats which are hollow can rupture and floats which are solid can absorb water over time which increases their density and reduces their net buoyancy. Springs may suffer from decreasing bias over time due to strain and repeated cyclical motion. Metallic springs can often corrode due to a variety of elemental exposures. Flexible conduits such as bellows and hoses, operating in conditions where the pressure outside of the conduit is greater than the pressure inside of the conduit, may collapse from the effects of excess hydrostatic pressure, often at depths much less than the design depth of the storage reservoir in which they are immersed.

Accordingly, there is a need for a flow control system that does not rely on floats, biasing members such as springs, or flexible conduits which are immersed in the fluid reservoir from which the flow control system is intended to control the release.

SUMMARY

The flow control system of the present invention includes an expanding conduit, an axis of which is vertical, and is fluidly interfaced, through a closed conduit, to an upstream reservoir and the interior of a container which is fluidly interfaced to a downstream drainage system. The distal, upper end of the expanding conduit is capped and at least one fluid passageway, which opens from the interior of the expanding conduit through the distal, capped, upper end of the expanding conduit is provided. If at least one fluid passageway through the distal, capped, upper end of the expanding conduit is oriented horizontally, the fluid passageway has an open area which is smaller than the cross sectional area of the inner dimensions of the expanding conduit. A means to restrain the expanding conduit from lateral motion is also provided and allows for a fluid connection between the interior of the expanding conduit and the interior of the container. When the fluid level in the upstream reservoir is at its initial, minimum, controlled level, the expanding conduit is in a less than fully expanded state, and the lowest point of at least one fluid passageway, which opens from the interior of the expanding conduit, is at the same initial and minimum level. As the upstream reservoir receives inflow and the fluid level rises above the initial, minimum, controlled level, the fluid flows from the reservoir, through the closed conduit, upward through the expanding conduit, out through at least one fluid passageway provided through the distal, capped, upper end of the expanding conduit, where it then passes through the means to restrain the expanding conduit from lateral motion and into the interior of the container, wherein it then flows out to the downstream drainage system which is fluidly interfaced to the container. Further, as the fluid level in the upstream reservoir continues to rise, the fluid pressure in the interior of the expanding conduit rises and, in turn, exerts an upward force on the underside of the distal, capped, upper end of the expanding conduit, and thereby moves the distal, capped, upper end of the expanding conduit, and at least one fluid passageway which opens from the interior of the expanding conduit, upward to a prescribed level which is below the fluid level in the upstream reservoir, and the rate of flow through the flow control system is maintained at the desirable release rate or range of release rates prescribed for the fluid handling system.

In one embodiment, a flow control system for integration into a fluid handling system, wherein the upstream fluid level varies, is disclosed including an expanding conduit in the form of a bellows, an axis of which is vertical, and is fluidly interfaced, through a closed conduit, to an upstream reservoir, and the interior of a container which is fluidly interfaced to a downstream drainage system. The distal, upper end of the bellows is capped and at least one fluid passageway, which opens from the interior of the expanding conduit through the distal, capped, upper end of the expanding conduit, is provided. At least one fluid passageway is oriented horizontally and has an open area which is less than the cross sectional area of the inner dimensions of the bellows.

The bellows is enclosed by a rigid tube, an axis of which is also vertical, and restrains the bellows from lateral movement. The rigid tube has at least one opening along its axis such that it is fluidly connected to the inside of the container and the downstream drainage system. When the fluid level in the upstream reservoir is at its initial, minimum, controlled level, the bellows is in a less than fully expanded state and at least one passageway through the distal, capped, upper end of the bellows is at a same initial, minimum level. As the upstream reservoir receives inflow and the fluid rises above the initial, minimum, controlled level, the fluid flows from the reservoir, through the closed conduit, upward through the bellows, out through at least one fluid passageway at the distal, capped, upper end of the bellows and into the interior of the rigid tube enclosing the bellows, wherein it flows out through at least one opening along its axis into the interior of the container, wherein it then flows out to the downstream drainage system interfaced to the container. Further, as the fluid level in the upstream reservoir continues to rise, the fluid pressure in the interior of the bellows rises and, in turn, exerts an upward force on the underside of the distal, capped, upper end of the bellows, and moves the distal, capped, upper end of the bellows, and at least one fluid passageway, which opens from the interior of the bellows, upward to a prescribed level which is below the fluid level in the upstream reservoir, and the rate of flow through the flow control system is maintained at the desirable release rate or range of release rates prescribed for the fluid handling system.

In another embodiment, a flow control system for integration into a fluid handling system, wherein the upstream fluid level varies, is disclosed including an expanding conduit in the form of a bellows, an axis of which is vertical, and is fluidly interfaced, through a closed conduit, to an upstream reservoir, and the interior of a container which is fluidly interfaced to a downstream drainage system. The distal, upper end of the bellows is capped and at least one fluid passageway, which opens from the interior of the expanding conduit through the distal, capped, upper end of the expanding conduit, is provided. At least one fluid passageway is oriented vertically. The bellows is enclosed by a rigid tube, an axis of which is also vertical, and restrains the bellows from lateral movement. The rigid tube has at least one opening along its axis such that it is fluidly connected to the inside of the container and the downstream drainage system. When the fluid level in the upstream reservoir is at its initial, minimum, controlled level, the bellows is in a less than fully expanded state and the lowest point of at least one fluid passageway through the distal, capped, upper end of the bellows is at a same initial, minimum level. As the upstream reservoir receives inflow and the fluid rises above the initial, minimum, controlled level, the fluid flows from the reservoir, through the closed conduit, upward through the bellows, out through at least one fluid passageway at the distal, capped, upper end of the bellows into the interior of the rigid tube enclosing the bellows, wherein it flows out through the opening along its axis into the interior of the container, wherein it then flows out to the downstream drainage system interfaced to the container. Further, as the fluid level in the upstream reservoir continues to rise, the fluid pressure in the interior of the bellows rises and, in turn, exerts an upward force on the underside of the distal, capped, upper end of the bellows, and moves the distal, capped, upper end of the bellows and at least one fluid passageway which opens from the interior of the bellows, upward to a prescribed level which is below the fluid level in the upstream reservoir, and the rate of flow through the flow control system is maintained at the desirable release rate or range of release rates prescribed for the fluid handling system.

In another embodiment, a flow control system for integration into a fluid handling system, wherein the upstream fluid level varies, is disclosed including an expanding conduit in the form of a bellows, an axis of which is vertical, and is fluidly interfaced, through a closed conduit, to an upstream reservoir, and the interior of a container which is fluidly interfaced to a downstream drainage system. The distal, upper end of the bellows is capped and at least one fluid passageway which opens from the interior of the bellows is provided through the distal, capped, upper end of the bellows. At least one fluid passageway intersects the vertical axis of the distal, capped, upper end of the bellows and is provided in the form of a short tube oriented such that its exit into the interior of the container is directed downward. The bellows is enclosed by a rigid tube, an axis of which is also vertical, and restrains the bellows from lateral movement. The rigid tube has at least one slot along the length of its axis. At least one slot along the length of its axis is aligned such that the short tube is guided within the slot and its exit is fluidly connected to the inside of the container and the downstream drainage system. When the fluid level in the upstream reservoir is at its initial, minimum, controlled level, the bellows is in a less than fully expanded state and the lowest point of at least one fluid passageway through the distal, capped, upper end of the bellows, at the point where at least one fluid passageway intersects the distal, capped upper end of the bellows, is at a same initial, minimum level. As the upstream reservoir receives inflow and the fluid rises above the initial, minimum, controlled level, the fluid flows from the reservoir, through the closed conduit, upward through the bellows, out through at least one fluid passageway at the distal capped, upper end of the bellows into the interior of the rigid tube enclosing the bellows, wherein it flows out through the opening along its axis into the interior of the container, wherein it then flows out to the downstream drainage system interfaced to the container. Further, as the fluid level in the upstream reservoir continues to rise, the fluid pressure in the interior of the bellows rises and, in turn, exerts an upward force on the underside of the distal, capped, upper end of the bellows, and moves the distal, capped, upper end of the bellows and at least one fluid passageway which opens from the interior of the bellows, upward to a prescribed level which is below the fluid level in the upstream reservoir, and the rate of flow through the flow control system is maintained at the desirable release rate or range of release rates prescribed for the fluid handling system.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION AND PREFERRED EMBODIMENT

Figure 1:
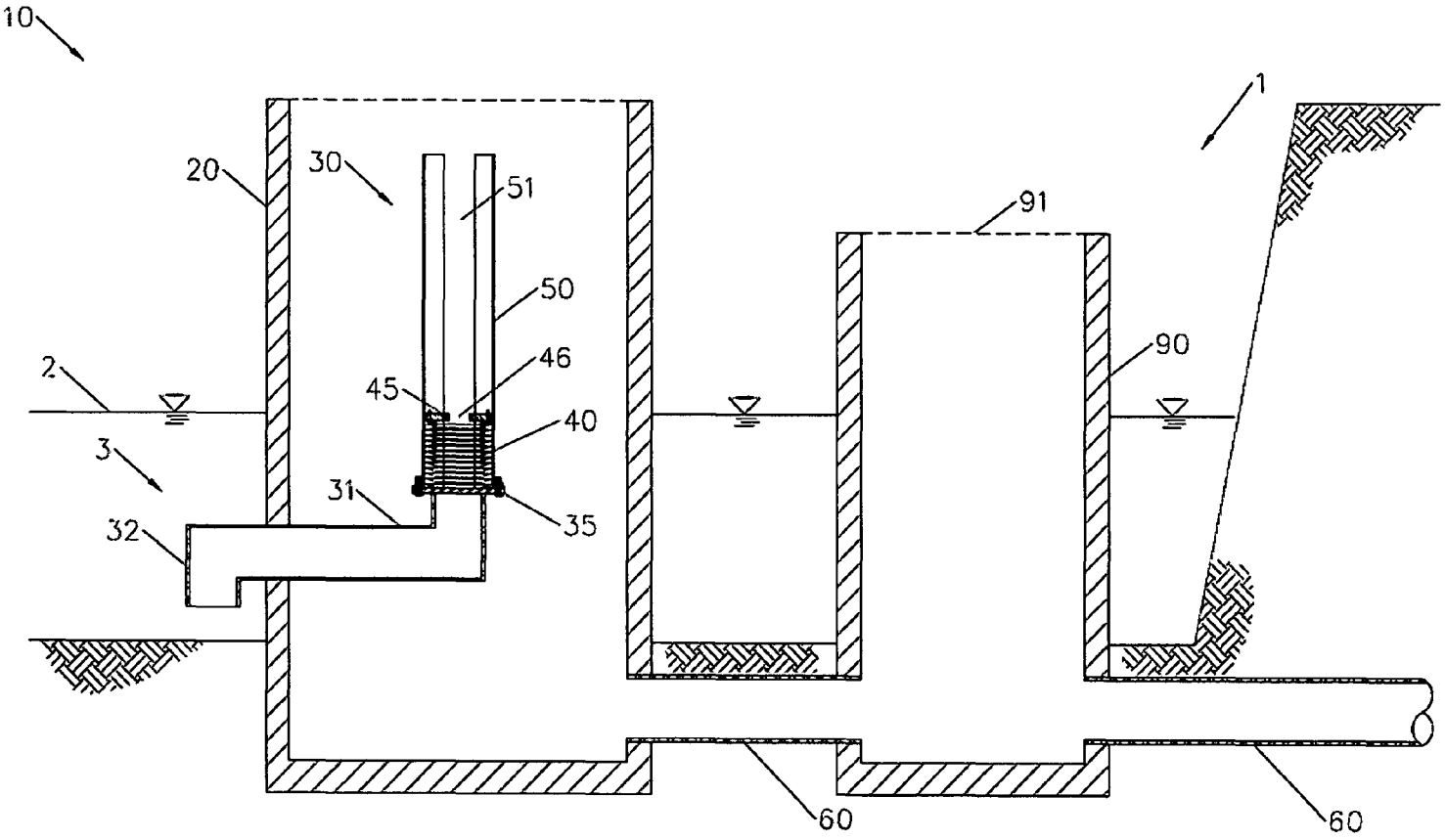
FIG. 1 illustrates a schematic of a system of the present invention wherein the fluid level in the upstream reservoir is at its initial, minimum, controlled level.

Reference will now be made in detail to the presently preferred embodiments of the invention, examples of which are illustrated in the accompanying drawings. Throughout the following detailed description, the same reference numerals refer to the same elements in all figures. Throughout the following description, the terms fluid handling system, detention pond, surge tank, holding tank, reservoir, and other applications wherein upstream fluid levels vary, represent any such structure and are equivalent structure for storing a fluid and discharging it at a prescribed, desirable rate or range of rates as the case may be.

The flow control system described provides for an initial discharge rate starting as soon as the upstream reservoir reaches a pre-determined, minimum, controlled fluid level. Then, as the fluid level increases, the discharge rate is controlled at a prescribed rate or range of rates until a high-water level is reached, at which level the flow control system provides for an increased discharge rate to reduce the possibility of exceeding the volumetric capacity of upstream reservoir.

Prior to more advanced flow control systems, limiting the maximum outflow rates was accomplished by the use of fixed weirs and orifices, flow control systems whereby the discharge was controlled in response to the movement of a float, or the bias of a spring, or flow control systems wherein a flexible conduit is immersed in such a manner that the pressure outside of the flexible conduit is greater than the pressure inside of the flexible conduit. Fixed weirs and orifices can only control the discharge rate within a broad range, determined by the range of the fluid level fluctuation in the upstream reservoir. Flow control systems whereby the discharge rate is controlled in response to the movement of floats can be subject to failure if hollow floats are ruptured. Solid displacement float can also suffer a decrease in their net buoyancy, over time, if the floats are formed from materials which have the propensity to absorb fluid. Flow control systems whereby the discharge rate is controlled in response to the bias from a spring can fail, over time, due to decreasing bias caused by strain and repeated cyclical motion, and metallic springs are vulnerable to the effects of corrosion from a variety of elemental exposures. Flow control systems wherein a flexible conduit is immersed in fluid, such that the pressure outside of the flexible conduit is greater than the pressure inside of the flexible conduit, are known to have a very limited range of depth at which they may operate without subjecting the flexible conduit to pressures at which the flexible conduit will collapse. The present invention solves these and other problems as is evident in the following description.

Referring to FIG. 1, a schematic view of a system of the present invention will be described. The flow control system 30 is incorporated into a fluid handling system 10 wherein the flow control system 30 receives the flow of fluid 3 from an upstream reservoir 1 and discharges the flow to a downstream drainage system 60.

The flow control system 30 consists of four primary components; a closed conduit 31, an expanding conduit in the form of a bellows 40 which is restrained from lateral movement, a cap 45, and a container 20. The closed conduit 31 is made of plastic, metal, concrete or any other material which is suitable for conveying the fluid 3, and is connected to the upstream reservoir 1 below the fluid surface 2. The downstream end of the closed conduit 31 is oriented such that its exit is directed upward and it is interfaced to the lower end of the bellows 40. The upstream end of the closed conduit 31 is equipped with an optional baffle 32, to prevent entry of undesirable materials such as trash, debris, greases, oils and the like from entering or possibly interfering with the operation of the flow control system 30. Although the optional baffle 32 is depicted in the form of an elbow oriented such that its entrance is directed downward, there are many ways to protect the inlet of the closed conduit 31 from the unwanted entry of undesirable materials. In some embodiments it is anticipated the closed conduit 31 may be protected by a screen, or by connecting its inlet to a surface skimming device.

The bellows 40 has an axis which is vertical and is made from rubber, polyurethane, plastic or any other any reasonably flexible, resilient and impervious material suitable for conveying the fluid 3. Although there are many ways to interface the lower end of the bellows 40 to the closed conduit 31, the lower end of the bellows 40 is connected to the closed conduit 31 by means of a flanged connection 35. In some embodiments it is anticipated the lower end of the bellows 40 has a collar which fits tightly over the outside of the closed conduit 31 and is fastened to the closed conduit 31 with clamps.

The distal, upper end of the bellows 40 is equipped with a cap 45 which is made from metal, plastic or any other sufficiently rigid material suitable for exposure to the fluid 3. The cap 45 has at least one fluid passageway 46 which provides an opening from the interior of the bellows 40. The fluid passageway 46 is oriented horizontally and has an open area which is smaller than the cross sectional area of the inner dimension of the bellows 40. In some embodiments, the cap 45 is a component which is separate, and is fastened to the upper end of the bellows 40. In other embodiments, the cap 45 is made integral to the bellows 40.

The bellows 40 is enclosed by a rigid tube 50, an axis of which is vertical, and which has a slot 51 provided along the length of its axis of sufficient width such that the interior of the rigid tube 50 is freely and fluidly connected to the interior of the container 20. Although only a single slot 51 is shown, it is anticipated that in some embodiments there may be more than one slot 51. The interior dimension of the rigid tube 50 is sufficient to accommodate the exterior dimension of the bellows 40 such that the bellows 40 is free to expand upwardly, yet is restrained from moving laterally. The rigid tube 50 is made of metal, plastic or any other material which is suitable for exposure to the fluid 3 and is sufficiently rigid to maintain its axis vertical and resist the forces of hydrostatic pressure which are anticipated to act on its interior surfaces.

The container 20 can be fashioned from materials such as concrete, metal, plastic or any other material or combination of materials which provide adequate structural integrity and are also reasonably impervious and suitable for exposure to the fluid 3. In some embodiments, the upper end of the container 20 may be open, and in other embodiments it may be closed, so long as the interior container 20 can be maintained at the ambient, atmospheric pressure. An overflow riser 90 is located downstream of the container 20 and is fluidly interfaced to the downstream drainage system 60, at a point which is downstream from the container 20. The overflow riser 90 is made of concrete, metal, plastic or any other material which has adequate structural integrity and is suitable for conveying discharges of fluid 3. When the fluid surface 2 in the reservoir 1 has risen to a level above the upper rim 91 of the overflow riser 90, the overflow riser 90 provides a means to accommodate an increased rate of discharge when the volumetric capacity of the reservoir 1 is in danger of being exceeded. Although both the container 20 and the overflow riser 90 are depicted as being positioned in the reservoir 1, it is not required. In some embodiments it is anticipated that the container 20 may be located outside of the reservoir 1 and the overflow riser 90 may be connected to the downstream drainage system 60 at a point downstream from the container 20 by means of a pipe which is routed around the container 20. The position of the overflow riser 90 within the flow control system 30 may be at any of a number of locations so long as its upper rim 91 is fluidly connected to the reservoir 1 and it is connected to the downstream drainage system 60 at a point which is downstream from the container 20.

The bellows 40 is depicted in a less than fully expanded state and the fluid passageway 46 through the cap 45 is at an initial level, at which the fluid surface 2 in the reservoir 1 is at the same level, and is the minimum, controlled level, at which there is no flow and no discharge of fluid 3 from the flow control system 30 into the downstream drainage system 60.

Figure 2:
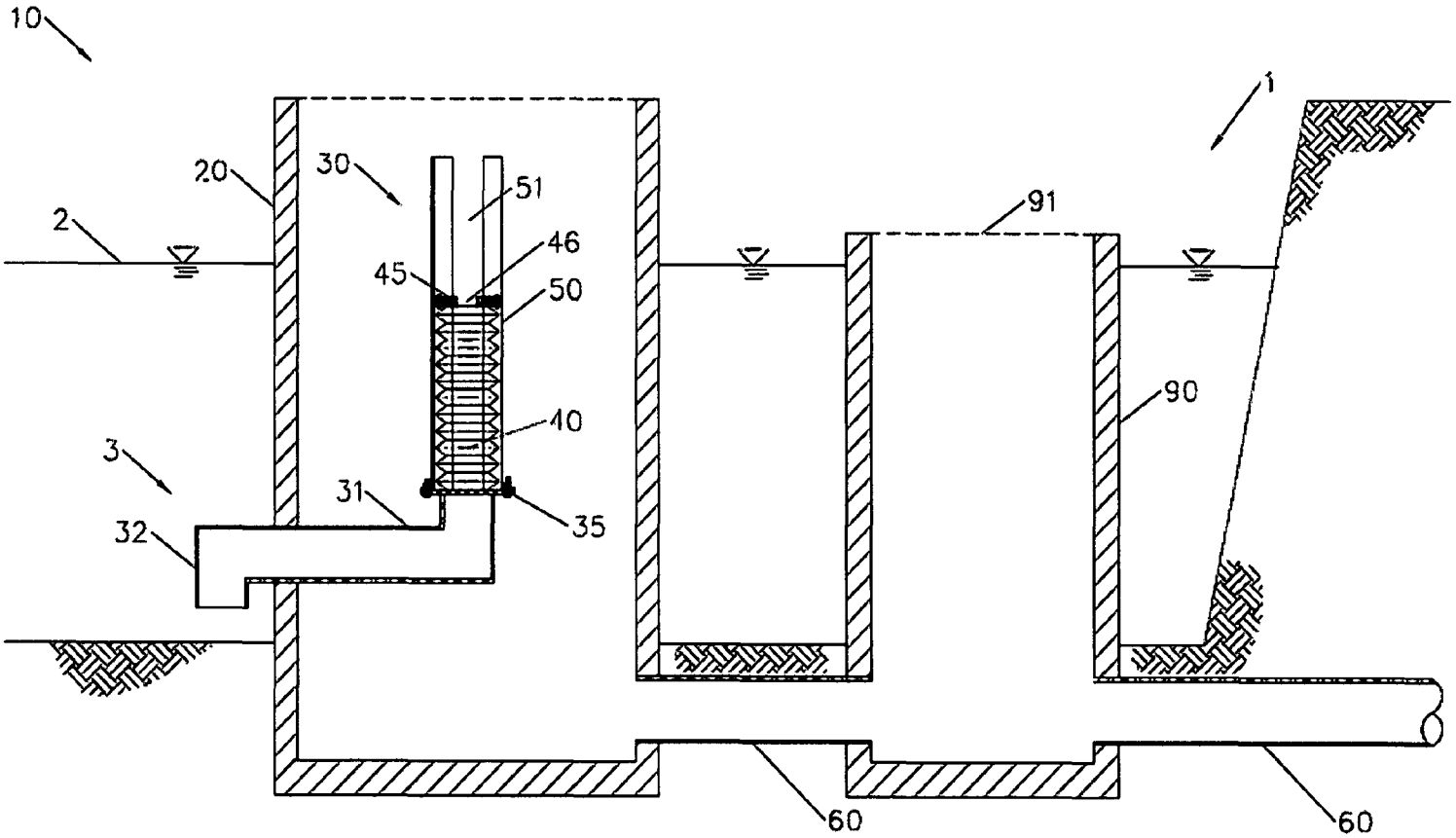
FIG. 2 illustrates a schematic of a system of the present invention wherein the fluid level in the upstream reservoir has risen above its minimum, controlled level.

Referring to FIG. 2, a schematic view of a system of the present invention will now be described. The flow control system 30 and fluid handling system 10 are the same flow control system 30 and fluid handling system 10 depicted in FIG. 1, wherein the flow control system 30 is incorporated into a fluid handling system 10, and wherein the flow control system 30 receives the flow of fluid 3 from an upstream reservoir 1 and discharges the flow to a downstream drainage system 60. The fluid surface 2 in the upstream reservoir 1 has risen above the initial, minimum, controlled level and the fluid 3 is flowing through the flow control system 30 from the upstream reservoir 1, through the optional baffle 32, into the closed conduit 31, upward through the bellows 40, and out through the fluid passageway 46, provided through the cap 45, and into the interior of the rigid tube 50, wherein it then freely discharges out through the slot 51 along the length of the vertical axis of the rigid tube 50 into the container 20 and out into the downstream drainage system 60. Since the fluid passageway 46 through the cap 45 has an open area which is smaller than the cross sectional area of the inner dimension of the bellows 40, the bellows 40 has expanded upward in response to the increase in system pressure caused by the rise of the fluid surface 2 in the upstream reservoir 1 and, in turn, the level of the fluid passageway 46 through the cap 45 has risen to a prescribed level which is below the fluid surface 2 in the upstream reservoir 1, and the rate of flow through the flow control system 30 is maintained at the desirable release rate or range of release rates prescribed for the fluid handling system 10.

Figure 3:
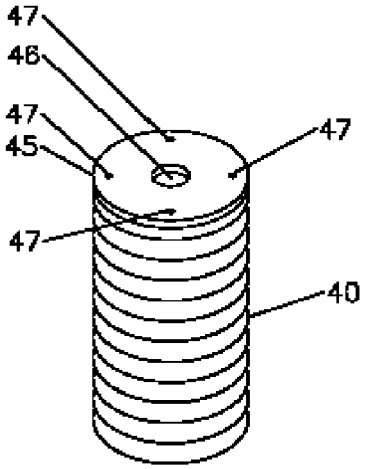
FIG. 3 illustrates a perspective view of the distal, capped, upper end of the expanding conduit of a first embodiment of the present invention.

Referring to FIG. 3, a perspective view of the distal, upper end of the bellows 40 of a first embodiment of the present invention will be described. The distal, upper end of the bellows 40 is fitted with a cap 45 through which a fluid passageway 46 is provided. The open area of the fluid passageway 46 is smaller than the area of the inner dimensions of the bellows 40. Although the bellows 40 is depicted as having a circular cross section, the bellows 40 may have a cross section of any geometry and it is anticipated that in some embodiments the bellows 40 may have a cross section which is non-circular. Similarly, the fluid passageway 46 is also depicted as being a single, circular opening; however, it may be provided in any number of a plurality of openings and geometric configurations suitable for limiting the release rate to the desirable release rate prescribed for the application. The cap 45 is in the form of a plate which is firmly attached to the bellows 40 in a fluid tight manner by an array of fasteners 47. The cap 45 can be made of metal, plastic, or any other material which provides sufficient strength and rigidity to convey the upward force of increasing pressure, through the array of fasteners 47 to the upper end of the bellows 40. The fasteners 47 may be screws, bolts, pins, staples or any other type of fastener suitable for making a firm and fluid tight connection to the distal, upper end of the bellows 40; however, the fasteners are optional as a firm and fluid tight connection between the cap 45 and the upper end of the bellows 40 may also be accomplished by a flanged connection, or by welding, fusing or the use of adhesives.

Figure 3A:
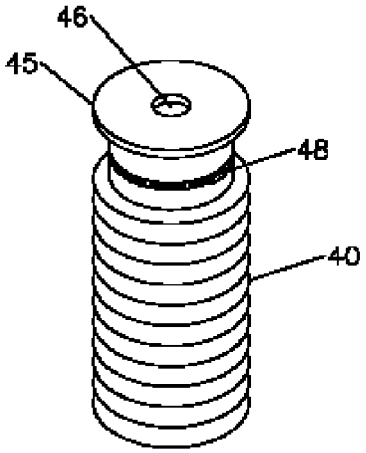
FIG. 3A illustrates a perspective view of an alternate distal, capped, upper end of the expanding conduit of a first embodiment of the present invention.

Referring to FIG. 3A, a perspective view of an alternate distal, upper end of the bellows 40 of a first embodiment of the present invention will be described. The distal, upper end of the bellows 40 is formed with an integral collar, into which a cap 45, through which there is a fluid passageway 46 which has an open area less than the cross sectional area of the inner dimension of the bellows 40, has been inserted and fastened to upper end of the bellows 40 in a firm and fluid tight manner with a hose clamp 48. Although a single hose clamp 48 is depicted, it may be one or a plurality of hose clamps of any type and material suitable for making a firm and fluid tight connection between the integral collar provided at the upper end of the bellows 40 and that portion of the cap 45 which has been inserted into the integral collar at the upper end of the bellows 40. Further, the hose clamp 48 is optional as a firm and fluid tight connection can also be accomplished by welding, fusing or the use of adhesives. Although the fluid passageway 46 is depicted as being a single, circular opening; it may be provided in any number of a plurality of openings and geometric configurations suitable for limiting the release rate to the desirable release rate prescribed for the application.

Figure 3B:
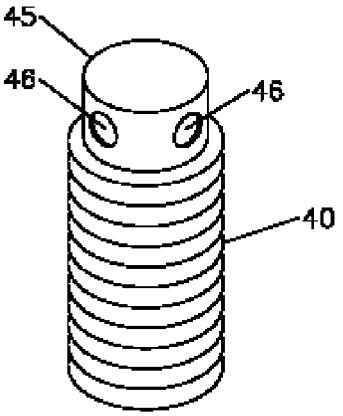
FIG. 3B illustrates a perspective view of the distal, capped, upper end of the expanding conduit of a second embodiment of the present invention.

Referring to FIG. 3B, a perspective view of the upper end of the bellows 40 of a second embodiment of the present invention will be described. The distal, upper end of the bellows 40 is fitted with a cap 45 through which a plurality of fluid passageways 46 have been provided, in an orientation which is vertical, such that the discharge from the interior of the bellows 40 is directed horizontally. Although a plurality of fluid passageways 46 are depicted, only a single fluid passageway 46 is required so long as it is of sufficient area to limit the flow rate to the desirable release rate for the application. When the fluid passageway(s) 46 are oriented vertically, as shown, it is not necessary that they have an open area which is less than the cross sectional area of the inner dimensions of the bellows 40. The cap 45 is fastened to the upper end of the bellows 40 in a firm and fluid tight manner by any number of means which accomplish such a connection, and further, it is not necessary that the cap 45 be provided as a separate part, as it may be made integral to the bellows 40.

Figure 3C:
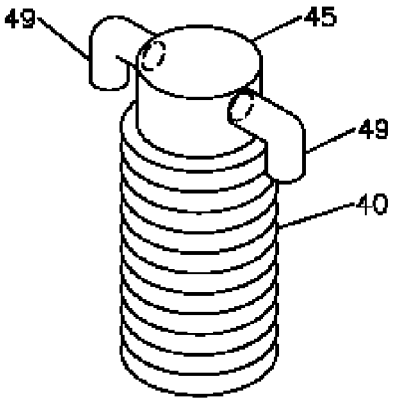
FIG. 3C illustrates a perspective view of the distal, capped, upper end of the expanding conduit of a third embodiment of the present invention.

Referring to FIG. 3C, a perspective view of the distal, upper end of the bellows 40 of a third embodiment of the present invention will be described. The distal, upper end of the bellows 40 has been fitted with a cap 45, through which a plurality of fluid passageways 49, are provided in the form of a short tube oriented such that its exit into the interior of the container is directed downward. The fluid passageways 49 intersect the vertical axis of the cap 45 and open from the interior of the bellows 40. Although a plurality of fluid passageways 49 are depicted, only a single fluid passageway 49 is required, so long as it is of sufficient area to pass the desired release rate for the application. Whereas the fluid passageways 49 intersect the vertical axis of the cap 45, it is not necessary that they have an open area which is less than the cross sectional area of the inner dimensions of the bellows 40 and it is anticipated that the fluid passageways 49 may have open areas which are larger or smaller than the cross sectional area of the inner dimensions of the bellows 40. The cap 45 is fastened to the upper end of the bellows 40 in a firm and fluid tight manner by any number of means which accomplish such a connection, and further, it is not necessary that the cap 45 be provided as a separate part, as it may be made integral to the bellows 40.

Figure 4:
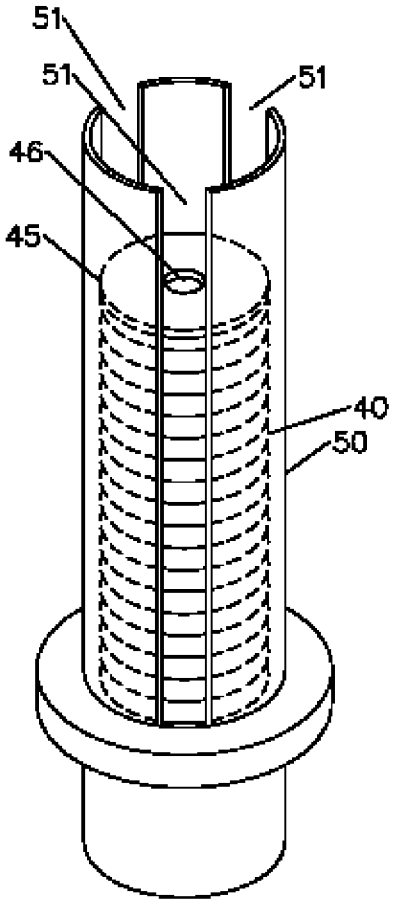
FIG. 4 illustrates a perspective view of the expanding conduit enclosed within a means to prevent lateral movement of a first embodiment of the present invention.

Referring to FIG. 4, a perspective view of the rigid tube which encloses and restrains the bellows 40 of a first embodiment of the present invention from lateral movement will be described. The bellows 40, an axis of which is vertical, is fitted within and enclosed by a rigid tube 50, an axis of which is also vertical, and through which a plurality of slots 51 along the length of its axis are provided. The rigid tube 50 is made of metal, plastic or any other material which has sufficient rigidity to maintain it at an axis which is vertical and resist the forces of hydrostatic pressure which are anticipated to act on its interior surfaces. The rigid tube 50 has an inner dimension which is sufficient to accommodate the outer dimension of the bellows 40, such that the bellows 40 is restrained against lateral movement, yet is free to expand upwardly when the fluid pressure in the interior of the bellows rises and thereby exerts a force on the underside of the cap 45 and raises the level of the fluid passageway 46 through the cap 45, to the prescribed level which produces the desirable release rate for the application. Although a plurality of slots 51 along the axis of the rigid tube 50 are depicted, only a single slot 51 is required, so long as its width is sufficient to pass the desirable release rate, while accommodating free discharge through the fluid passageway 46 provided through the cap 45.

Figure 4A:
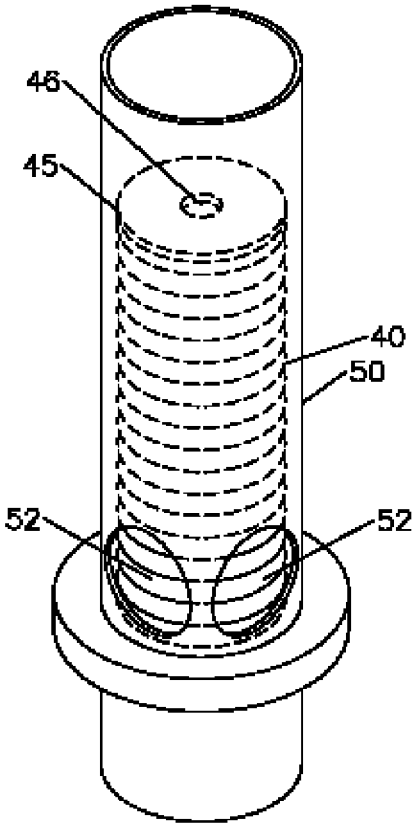
FIG. 4A illustrates a perspective view of the expanding conduit enclosed within an alternate means to prevent lateral movement of the present invention.

Referring to FIG. 4A, a perspective view of an alternate rigid tube 50 which encloses and restrains the bellows 40 of a first embodiment of the present invention from lateral movement will be described. The bellows 40, an axis of which is vertical, is fitted within and enclosed by a rigid tube 50, an axis of which is also vertical, through which a plurality of openings 52 are provided near its lower end. The rigid tube 50 is made of metal, plastic or any other material which has sufficient rigidity to maintain it at an axis which is vertical and resist the forces of hydrostatic pressure which are anticipated to act on its interior surfaces. The rigid tube 50 has an inner dimension which is sufficient to accommodate the outer dimension of the bellows 40, such that the bellows 40 is restrained against lateral movement, yet is free to expand upwardly when the fluid pressure in the interior of the bellows rises and thereby exerts a force on the underside of the cap 45 and raises the level of the fluid passageway 46 through the cap 45, to the prescribed level which produces the desirable release rate for the application. Although a plurality of round openings 52 are depicted near the lower end of the rigid tube 50, only a single opening 52 of any geometric configuration is required, so long as the opening 52 has an area which is sufficient to pass the desirable release rate for the application, while accommodating a free discharge through the fluid passageway 46 provided through the cap 45.

Figure 4B:
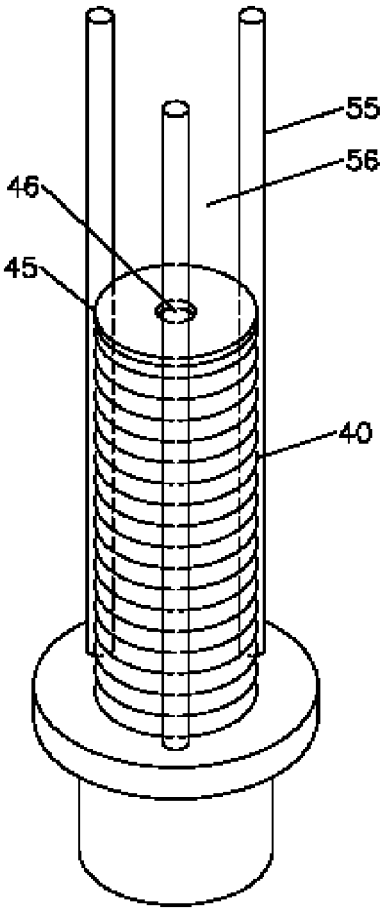
FIG. 4B illustrates a perspective view of the expanding conduit of a first embodiment of the present invention enclosed by a second alternate means to prevent lateral movement.

Referring to FIG. 4B, a perspective view of an alternate means to restrain the bellows 40 of a first embodiment of the present invention from lateral movement will be described. The bellows 40, an axis of which is vertical, is fitted within and enclosed by an array of rigid bars 55, the axes of which are also vertical. The rigid bars 55 are made of metal, plastic or any other material which has sufficient rigidity to maintain them at an axis which is vertical and resist the forces of hydrostatic pressure which are anticipated to act on them. The array of rigid bars 55 has an inner dimension which is sufficient to accommodate the outer dimension of the bellows 40, such that the bellows 40 is restrained against lateral movement, yet is free to expand upwardly when the fluid pressure in the interior of the bellows rises and thereby exerts a force on the underside of the cap 45 and raises the level of the fluid passageway 46 through the cap 45, to the prescribed level which produces the desirable release rate for the application. The spaces 56 between the rigid bars 55 are sufficient to pass the desirable release rate for the application, while accommodating free discharge through the fluid passageway 46 provided through the cap 45. Although three rigid bars 55 are depicted, any number of rigid bars 55 may be provided so long as they arrayed in such a fashion as to restrain the bellows 40 from lateral movement and the spaces 56 between the rigid bars 55 are sufficient to accommodate free discharge through the fluid passageway 46 provided through the cap 45. Further, although the rigid bars 55 are depicted as having a round cross section, it is anticipated that they may be provided in any number of geometric cross sections such as rectangular or tubular.

Figure 4C:
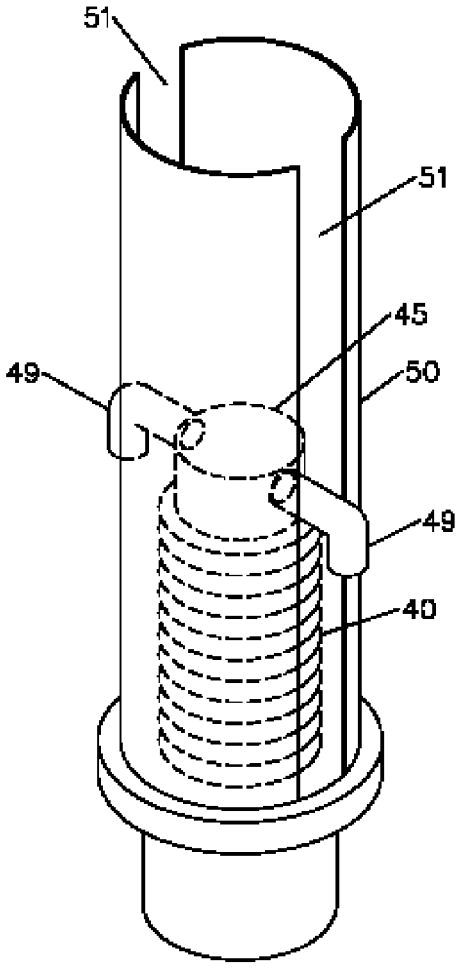
FIG. 4C illustrates a perspective view of the expanding conduit enclosed within a third alternate means to prevent lateral movement of the present invention.

Referring to FIG. 4C, a perspective view of the rigid tube 50 which encloses and restrains the bellows 40 of a third embodiment of the present invention from lateral movement will be described. The bellows 40, an axis of which is vertical, is enclosed within a rigid tube 50, an axis of which is also vertical, and has two slots 51 along the length of its axis. The slots 51 are of sufficient width to freely accommodate the outer dimension of the tubular shaped, fluid passageways 49 protruding from the cap 45, which has been fitted to or made integral to the distal, upper end of the bellows 40. The rigid tube 50 is made of metal, plastic or any other material which has sufficient rigidity to maintain it at an axis which is vertical and resist the forces of hydrostatic pressure which are anticipated to act on its interior surfaces. The rigid tube 50 has an inner dimension which is sufficient to accommodate the outer dimension of the bellows 40, such that the bellows 40 is restrained against lateral movement, yet is free to expand upwardly when the fluid pressure in the interior of the bellows rises and thereby exerts a force on the underside of the cap 45 and raises the level of the tubular shaped fluid passageways 49 provided through the cap 45, to the prescribed level which produces the desirable release rate for the application. Although two slots 51 and two, tubular shaped fluid passageways 49 which protrude from the cap 45 and through the slots 51 are depicted, any number of slots 51 and tubular shaped, fluid passageways 49 may be provided, so long as the total area of the tubular shaped fluid passageway 49 or fluid passageways 49, as the case may be, have an area which is sufficient to limit discharge to the desired release rate.

Figure 5:
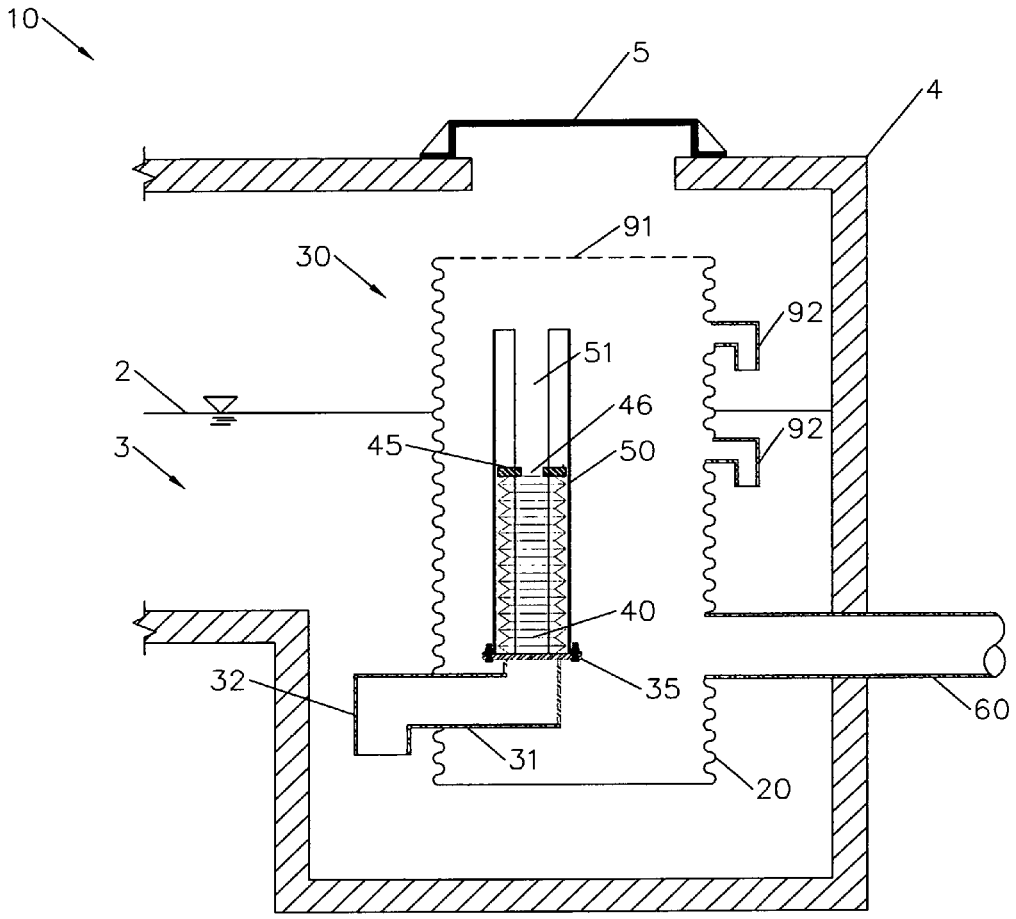
FIG. 5 illustrates a schematic of an alternate embodiment of the present invention.

Referring to FIG. 5, a schematic view of an alternate system of the present invention will be described. The flow control system 30 is incorporated into a holding tank 4 wherein the fluid 3, stored in the holding tank, is flowing through the flow control system 30 and into a downstream drainage system 60. The flow control system 30 is positioned beneath an optional accessway 5, through the top of the holding tank 4, such that the flow control system 30 is easily accessed from the surface for inspection or maintenance. The accessway 5 is depicted as a manhole rim and cover; however, in some embodiments, it is anticipated that the accessway 5 may be provided in the form of a catch basin grate, hatch cover or any number of other suitable means to provide access from the surface into the interior of the holding tank 4. The closed conduit 31 is made of plastic, metal, concrete or any other material which is suitable for conveying the fluid 3, and is connected to the upstream reservoir 1 below the fluid surface 2. The downstream end of the closed conduit 31 is oriented such that its exit is directed upward and it is interfaced to the lower end of an expanding conduit provided in the form of a bellows 40. The upstream end of the closed conduit 31 is equipped with an optional baffle 32, to prevent entry of undesirable materials such as trash, debris, greases, oils and the like from entering or possibly interfering with the operation of the flow control system 30. Although the optional baffle 32 is depicted in the form of an elbow oriented such that its entrance is directed downward, there are many ways to protect the inlet of the closed conduit 31 from the unwanted entry of undesirable materials. In some embodiments it is anticipated the closed conduit 31 may be protected by a screen, or by connecting its inlet to a surface skimming device.

The bellows 40 has an axis which is vertical and is made from rubber, polyurethane, plastic or any other any reasonably flexible, resilient and impervious material suitable for conveying the fluid 3. Although there are many ways to interface the lower end of the bellows 40 to the closed conduit 31, the lower end of the bellows 40 is connected to the closed conduit 31 by means of a flanged connection 35. In some embodiments it is anticipated the lower end of the bellows 40 has collar which fits tightly over the outside of the closed conduit 31 and is fastened to the closed conduit with clamps.

The distal, upper end of the bellows 40 is equipped with a cap 45 which is made from metal, plastic or any other sufficiently rigid material suitable for exposure to the fluid 3. The cap 45 has at least one fluid passageway 46 which provides an opening from the interior of the bellows 40. The fluid passageway 46 is oriented vertically or horizontally and has an open area which is smaller than the cross sectional area of the inner dimension of the bellows 40. In some embodiments, the cap 45 is a component which is separate, and is fastened to the upper end of the bellows 40. In other embodiments, the cap 45 is made integral to the bellows 40.

The bellows 40 is enclosed by a rigid tube 50, an axis of which is vertical, and which has a slot 51, provided along the length of its axis, of sufficient width, such that the interior of the rigid tube 50 is freely and fluidly connected to the interior of the container 20. Although only a single slot 51 is shown, it is anticipated that in some embodiments there may be more than one slot 51. The interior dimension of the rigid tube 50 is sufficient to accommodate the exterior dimension of the bellows 40 such that the bellows 40 is free to expand upwardly, yet is restrained from moving laterally. The rigid tube 50 is made of metal, plastic or any other material which is sufficiently rigid to maintain its axis vertical and resist the forces of hydrostatic pressure which are anticipated to act on its interior surfaces.

The container 20 can be fashioned from materials such as concrete, metal, plastic or any other material or combination of materials which provide adequate structural integrity and are also reasonably impervious and suitable for exposure to the fluid 3. The upper end of the container 20 is open and its upper rim 91 is positioned at a prescribed level such that if the fluid surface 2 rises above the level of the upper rim 91 of the container and the volumetric capacity of the holding tank 4 is at risk of being exceeded, the container 20 can also function as an overflow riser and provide a means to accommodate an increased rate of discharge. In some embodiments, the upper rim 91 of the container 20 may be notched, in any number of geometric configurations, to create one or more additional overflow weirs at prescribed levels below the upper rim 91 of the container 20. Although it is most convenient to utilize the container 20 as the means to provide an increased rate of discharge when the volumetric capacity of the holding tank 4 is at risk of being exceeded, it is not required. In some embodiments it is anticipated that a separate means to provide overflow control will be provided. The container 20 has also been fitted with additional, optional, inlets 92, which open from the interior of the holding tank 4 into the interior of the container 20, at prescribed levels, and provide a means to gradually increase the rate of discharge through the flow control system 30 as the fluid surface 2 in the holding tank 4 rises. Although two inlets 92 are depicted, it is anticipated there may be any number of inlets 92 positioned at varying and prescribed levels along the vertical axis of the container 20. Although the flow control system 30 is depicted as being positioned within the holding tank 4, it is not required. In some embodiments it is anticipated that the container 20 may be located outside of the holding tank 4 and is housed in a separate chamber, such as a manhole, which is fluidly connected to the interior of the holding tank 4 and downstream drainage system 60.

Figure 6:
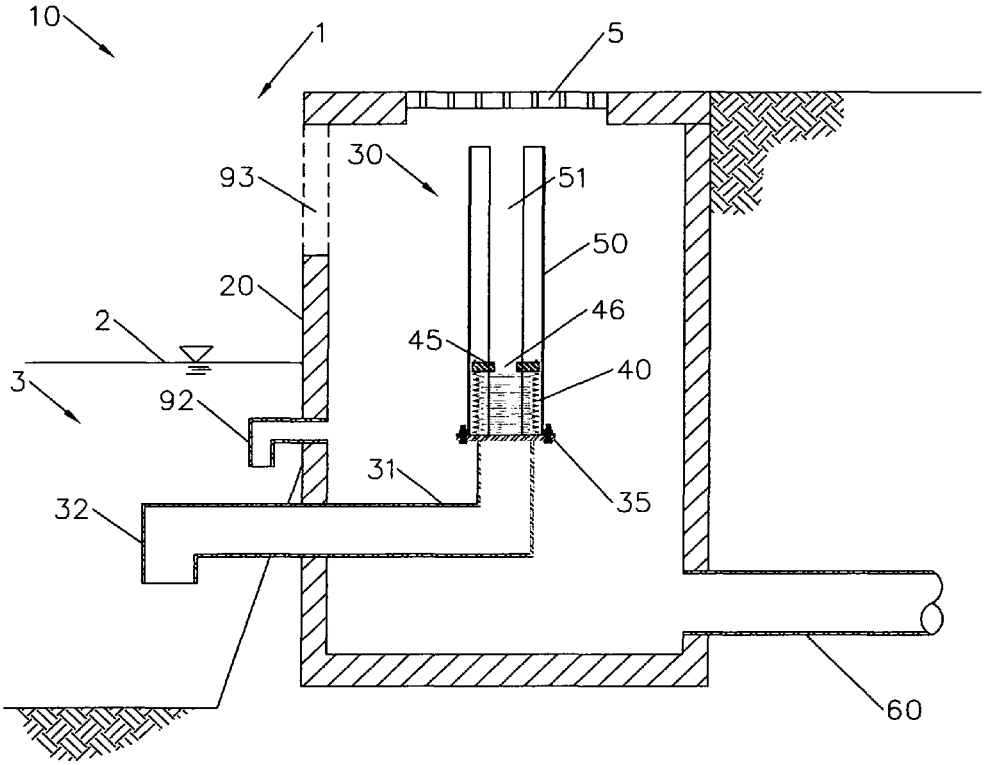
FIG. 6 illustrates a schematic of a second alternate embodiment of the present invention.

Referring to FIG. 6, a schematic view of a second alternate system of the present invention will be described. The flow control system 30 is incorporated into the bank of a reservoir 1 and is fluidly interfaced to the reservoir 1. The flow control system 30 is positioned beneath an optional accessway 5, through the top of the container 20, such that the flow control system is easily accessed from the bank of the reservoir 1 for inspection or maintenance. The accessway 5 is depicted as a catch basin grate; however, in some embodiments, it is anticipated that the accessway 5 may be provided in the form of a manhole rim and cover, hatch cover or any number of other suitable means to provide access from into the interior of the container 20 from above. The closed conduit 31 is made of plastic, metal, concrete or any other material which is suitable for conveying the fluid 3, and is connected to the upstream reservoir 1 below the fluid surface 2. The downstream end of the closed conduit 31 is oriented such that its exit is directed upward and it is interfaced to the lower end of an expanding conduit provided in the form a bellows 40. The upstream end of the closed conduit 31 is equipped with an optional baffle 32, to prevent entry of undesirable materials such as trash, debris, greases, oils and the like from entering or possibly interfering with the operation of the flow control system 30. Although the optional baffle 32 is depicted in the form of an elbow oriented such that its entrance is directed downward, there are many ways to protect the inlet of the closed conduit 31 from the unwanted entry of undesirable materials. In some embodiments it is anticipated the closed conduit 31 may be protected by a screen, or by connecting its inlet to a surface skimming device.

The bellows 40, has an axis which is vertical, and is made from rubber, polyurethane, plastic or any other any reasonably flexible, resilient and impervious material suitable for conveying the fluid 3. Although there are many ways to interface the lower end of the bellows 40 to the closed conduit 31, the lower end of the bellows 40 is connected to the closed conduit 31 by means of a flanged connection 35. In some embodiments it is anticipated the lower end of the bellows 40 has a collar which fits tightly over the outside of the closed conduit 31 and is fastened to the closed conduit with clamps.

The distal, upper end of the bellows 40 is equipped with a cap 45 which is made from metal, plastic or any other sufficiently rigid material suitable for exposure to the fluid 3. The cap 45 has at least one fluid passageway 46 which provides an opening from the interior of the bellows 40. The fluid passageway 46 is oriented vertically or horizontally and has an open area which is smaller than the cross sectional area of the inner dimension of the bellows 40. In some embodiments, the cap 45 is a component which is separate, and is fastened to the upper end of the bellows 40. In other embodiments, the cap 45 is made integral to the bellows 40.

The bellows 40 is enclosed by a rigid tube 50, an axis of which is vertical, and which has a slot 51 provided along the length of its axis, of sufficient width, such that the interior of the rigid tube 50 is freely and fluidly connected to the interior of the container 20. Although only a single slot 51 is shown, it is anticipated that in some embodiments there may be more than one slot 51. The interior dimension of the rigid tube 50 is sufficient to accommodate the exterior dimension of the bellows 40 such that the bellows 40 is free to expand upwardly, yet is restrained from moving laterally. The rigid tube 50 is made of metal, plastic or any other material which is sufficiently rigid to maintain its axis vertical and resist the forces of hydrostatic pressure which are anticipated to act on its interior surfaces.

The container 20 can be fashioned from materials such as concrete, metal, plastic or any other material or combination of materials which provide adequate structural integrity and are also reasonably impervious and suitable for exposure to the fluid 3. An overflow weir 93 is provided, at a prescribed level, through the wall of the container 20 that is in communication with the fluid 3 in the reservoir 1. The overflow weir 93 provides a means to accommodate an increased rate of discharge when the volumetric capacity of the reservoir 1 is at risk of being exceeded. The overflow weir 93 may be provided in any number of geometric configurations and any number of prescribed levels. Further, it is also anticipated there may be more than one overflow weir 93 provided through the walls of the container 20 which are in communication with the fluid 3 in the reservoir 1. Although it is most convenient to utilize the container 20 as the means to provide an increased rate of discharge when the volumetric capacity of the reservoir 1 is at risk of being exceeded, it is not required. In some embodiments it is anticipated that a separate means to provide overflow control will be provided.

The bellows 40 is depicted in a less than fully expanded state and the fluid passageway 46 through the cap 45 is at an initial level, at which the fluid surface 2 in the reservoir 1 is at the same level, and is the minimum, controlled level, at which there is no flow and no discharge of fluid 3 from the flow control system 30 into the downstream drainage system 60; however, the container 20 has also been fitted with additional, optional, inlet 92, which opens from the reservoir 1 to the interior of the container 20. The optional inlet 92 is depicted below the fluid surface 2 in the reservoir 1, and fluid 3 is flowing through the optional inlet 92 into the interior of the container 20 and out into the downstream drainage system 60. When the optional inlet 92 operates at levels below the initial, minimum, controlled level, it provides a means to drain the level of the reservoir 1 below the initial, minimum, controlled level. Although, only one optional inlet 92 is depicted, it is anticipated there may be a plurality of optional inlets 92 depending upon the requirements of the specific application. Further, it is anticipated that any number of optional inlets 92 may be provided above the initial, minimum, controlled level depending on the requirements of the specific application to provide a means to gradually increase the rate of discharge through the flow control system 30 as the fluid surface 2 in the reservoir 1 rises.

Although the flow control system 30 is depicted as being positioned in the bank of the reservoir 1, it is not required. In some embodiments it is anticipated that the container 20 may be located some distance downstream from the reservoir 1 and is housed in a separate chamber, such as a manhole, which is fluidly connected to the reservoir 1 and the downstream drainage system 60.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A flow control system for integration into detention ponds, surge tanks, reservoirs and other applications wherein upstream fluid levels vary in response to varying rates of inflow, the flow control system comprising:

a container, the container having an interior, the container interior being maintained at an ambient, atmospheric pressure being fluidly connected to a downstream drainage system;

a closed conduit, the closed conduit having an upstream end opening into a reservoir, the closed conduit having a downstream end within the container interior opening upward;

an expanding conduit, an axis of which is vertical, the expanding conduit having an interior, the lower end fluidly connected to said closed conduit downstream end, the expanding conduit distal, upper end having a cap affixed to the expanding conduit distal, upper end with an underside comprising a surface which fluid pressure within the expanding conduit can exert an upward force against and at least one fluid passageway which opens from the expanding conduit interior;

a means to restrain the expanding conduit from lateral movement, said means having an interior fluidly connected to said container interior;

whereas fluid flows from the upstream reservoir through the closed conduit, upward through the expanding conduit, exerts an upwards force against the surface which fluid within the expanding conduit can exert an upward pressure against, flows out through at least one fluid passageway opening from the expanding conduit interior through the expanding conduit distal, capped, upper end, into the interior of the means to restrain the expanding conduit from lateral movement, into the container interior and out into the downstream drainage system;

whereby expansion of the expanding conduit is achieved through pressure increase in the interior of the expanding conduit created by the fluid flowing through the expanding conduit.

2. The flow control system of claim 1, wherein the at least one fluid passageway, opening from the expanding conduit interior, said expanding conduit interior having an inner dimension and inner area, through the expanding conduit distal, capped, upper end, is oriented horizontally and has an open area smaller than the inner area of the inner dimension of the expanding conduit thereby creating a surface which fluid within the expanding conduit can exert an upward pressure against.

3. The flow control system of claim 1, wherein the at least one fluid passageway, opening from the expanding conduit interior through the expanding conduit distal, capped, upper end, is oriented vertically.

4. The flow control system of claim 1, wherein the at least one fluid passageway, opening from the expanding conduit interior through the expanding conduit distal, capped, upper end, is provided in the form of a tube; the tube exiting into and being fluidly connected to the container interior.

5. The flow control system of claim 1, wherein the expanding conduit is a bellows.

6. The flow control system of claim 1, wherein the means to restrain the expanding conduit from lateral movement is a rigid tube; an axis of which is vertical, the rigid tube having an interior, the rigid tube interior enclosing the expanding conduit, the rigid tube having at least one opening, along the axis of the rigid tube which is vertical, fluidly connecting the rigid tube interior to the container interior.

7. The flow control system of claim 6, wherein the at least one opening fluidly connecting the rigid tube interior to the container interior is a slot along the axis of the rigid tube.

8. The flow control system of claim 1, wherein the means to restrain the expanding conduit from lateral movement is an array of rigid bars, oriented vertically, the array of rigid bars having an interior and enclosing the expanding conduit within the interior of the array, the array of rigid bars having space between the rigid bars such that the interior of the array of rigid bars is fluidly connected to the container interior.

9. The flow control system of claim 5, wherein the at least one fluid passageway, opening from the expanding conduit interior through the expanding conduit distal, capped, upper end, is oriented horizontally and has an open area smaller than the area of the inner dimension of the expanding conduit thereby creating a surface which fluid within the expanding conduit can exert an upward pressure against.

10. The flow control system of claim 5, wherein the at least one fluid passageway, opening from the expanding conduit interior through the expanding conduit distal, capped, upper end, is oriented vertically.

11. The flow control system of claim 5, wherein the at least one fluid passageway, opening from the expanding conduit interior through the expanding conduit distal, capped, upper end, is provided in the form of a tube; the tube exiting into and being fluidly connected to the container interior.

12. The flow control system of claim 5, wherein the means to restrain the expanding conduit from lateral movement is a rigid tube; an axis of which is vertical, having an interior enclosing the expanding conduit, having at least one opening along the length of the axis of the rigid tube which is vertical fluidly connecting the rigid tube interior to the container interior.

13. The flow control system of claim 12, wherein the at least one opening fluidly connecting the rigid tube interior to the container interior is a slot along the axis of the rigid tube.

14. The flow control system of claim 5, wherein the means to restrain the expanding conduit from lateral movement is an array of rigid bars, having an interior and oriented vertically, enclosing the expanding conduit within the interior of the array, having space between the rigid bars such that the interior is fluidly connected to the container interior.

15. The flow control system of claim 11, wherein the means to restrain the expanding conduit from lateral movement is a rigid tube, an axis of which is vertical, having a length, an exterior dimension, an interior dimension, and at least one slot, said interior dimension enclosing the expanding conduit, said at least one slot having a length and a width, along the length of the axis of the rigid tube which is vertical, the width of the at least one slot being sufficient to accommodate the exterior dimension of the tube exiting into the container interior.

16. The flow control system of claim 11, wherein the means to restrain the expanding conduit from lateral movement is an array of rigid bars, having an interior and oriented vertically-enclosing the expanding conduit within the interior of the array, having space between the rigid bars sufficient to accommodate the exterior dimension of the tube exiting into the container interior.

17. A flow control system for integration into a holding tank, the flow control system comprising:

a container, installed within a holding tank, the container having an upper end which is open, the container having an upper rim positioned at a prescribed level, the container having an interior being maintained at an ambient, atmospheric pressure within the holding tank, and being fluidly connected to a downstream drainage system;

a closed conduit, the closed conduit having an upstream end opening into the holding tank, having a downstream end within the container interior, and having a downstream end opening upward;

an expanding conduit, an axis of which is vertical, having an interior with an inner dimension and inner area, a lower end fluidly connected to said closed conduit downstream end, the expanding conduit distal, upper end having a cap, through which at least one fluid passageway opens from the expanding conduit interior;

a means to restrain the expanding conduit from lateral movement, said means having an interior fluidly connected to the container interior;

whereas fluid flows from the holding tank through the closed conduit, upward through the expanding conduit, out through the at least one fluid passageway opening from the expanding conduit interior through the expanding conduit distal, capped, upper end, into the interior of the means to restrain the expanding conduit from lateral movement, into the container interior and out into the downstream drainage system;

whereas, when the fluid level in the holding tank rises above the prescribed level of the upper rim of the container, the fluid also flows over the upper rim of the container, into the interior of the container and out into the downstream drainage system.

18. The flow control system of claim 17, wherein the at least one fluid passageway, opening from the expanding conduit interior through the expanding conduit distal, capped, upper end, is oriented horizontally and has an open area smaller than the inner area of the inner dimension of the expanding conduit.

19. The flow control system of claim 17, wherein the at least one fluid passageway, opening from the expanding conduit interior through the expanding conduit distal, capped, upper end, is oriented vertically.

20. The flow control system of claim 17, wherein the at least one fluid passageway, opening from the expanding conduit interior through the expanding conduit distal, capped, upper end, is provided in the form of a tube; said tube having an interior and exterior dimension, the tube exiting into and being fluidly connected to the container interior.

21. The flow control system of claim 17, wherein the expanding conduit is a bellows.

22. The flow control system of claim 17, wherein the means to restrain the expanding conduit from lateral movement is a rigid tube; an axis of which is vertical, the rigid tube having an interior, the rigid tube interior enclosing the expanding conduit, the rigid tube having at least one opening, along the axis of the rigid tube which is vertical, fluidly connecting the rigid tube interior to the container interior.

23. The flow control system of claim 22, wherein the at least one opening fluidly connecting the rigid tube interior to the container interior is a slot along the axis of the rigid tube.

24. The flow control system of claim 17, wherein the means to restrain the expanding conduit from lateral movement is an array of rigid bars, having an interior and oriented vertically, enclosing the expanding conduit within the interior of the array, having space between the rigid bars such that the interior of the array of rigid bars is fluidly connected to the container interior.

25. The flow control system of claim 20, wherein the means to restrain the expanding conduit from lateral movement is a rigid tube, an axis of which is vertical, the rigid tube having an interior, the rigid tube interior enclosing the expanding conduit, the rigid tube having at least one slot, said at least one slot having a length and width along the axis of the rigid tube which is vertical, the width of the at least one slot being sufficient to accommodate the exterior dimension of the tube exiting into the container interior.

26. The flow control system of claim 20, wherein the means to restrain the expanding conduit from lateral movement is an array of rigid bars, having an interior and oriented vertically, the array of rigid bars enclosing the expanding conduit within the interior of the array, the array of rigid bars having space between the rigid bars sufficient to accommodate the exterior dimension of the tube exiting into the container interior.

27. A flow control system for integration into a reservoir, the flow control system comprising:

a container, the container being in communication with the fluid in the reservoir, having an overflow weir through a wall of the container and positioned at a prescribed level, the container having an interior being maintained at an ambient, atmospheric pressure, the container interior being fluidly connected to a downstream drainage system;

a closed conduit having an upstream end opening into a reservoir, and having a downstream end within the container interior, said downstream end opening upward;

an expanding conduit, an axis of which is vertical, the expanding conduit having an interior with an inner dimension and inner area, said expanding conduit also having a lower end, the lower end fluidly connected to said closed conduit downstream end, the expanding conduit distal, upper end having a cap, through which at least one fluid passageway opens from the expanding conduit interior;

a means to restrain the expanding conduit from lateral movement, having an interior fluidly connected to the container interior;

whereas fluid flows from the reservoir through the closed conduit, upward through the expanding conduit, out through the at least one fluid passageway opening from the expanding conduit interior through the expanding conduit distal, capped, upper end, into the interior of the means to restrain the expanding conduit from lateral movement, into the container interior and out into the downstream drainage system;

whereas, when the fluid level in the reservoir rises above the prescribed level of the overflow weir, the fluid also flows over the overflow weir, into the interior of the container and out into the downstream drainage system.

28. The flow control system of claim 27, wherein the at least one fluid passageway, opening from the expanding conduit interior through the expanding conduit distal, capped, upper end, is oriented horizontally and has an open area smaller than the inner area of the inner dimension of the expanding conduit.

29. The flow control system of claim 27, wherein the at least one fluid passageway, opening from the expanding conduit interior through the expanding conduit distal, capped, upper end, is oriented vertically.

30. The flow control system of claim 27, wherein the at least one fluid passageway, opening from the expanding conduit interior through the expanding conduit distal, capped, upper end, is provided in the form of a tube having an interior and exterior dimension; the tube exiting into and being fluidly connected to the container interior.

31. The flow control system of claim 27, wherein the expanding conduit is a bellows.

32. The flow control system of claim 27, wherein the means to restrain the expanding conduit from lateral movement is a rigid tube; an axis of which is vertical, the rigid tube having an interior, the rigid tube interior enclosing the expanding conduit, the rigid tube having at least one opening along the axis of the rigid tube which is vertical fluidly connecting the rigid tube interior to the container interior.

33. The flow control system of claim 32, wherein the at least one opening fluidly connecting the rigid tube interior to the container interior is a slot along the axis of the rigid tube.

34. The flow control system of claim 27, wherein the means to restrain the expanding conduit from lateral movement is an array of rigid bars, having an interior and oriented vertically, the array of rigid bars enclosing the expanding conduit within the interior of the array, the array of rigid bars having space between the rigid bars such that the interior of the array of rigid bars is fluidly connected to the container interior.

35. The flow control system of claim 30, wherein the means to restrain the expanding conduit from lateral movement is a rigid tube, an axis of which is vertical, the rigid tube having an interior enclosing the expanding conduit, the rigid tube having at least one slot, said at least one slot having a length and width, along the length of the axis of the rigid tube which is vertical, the width of the at least one slot being sufficient to accommodate the exterior dimension of the tube exiting into the container interior.

36. The flow control system of claim 30, wherein the means to restrain the expanding conduit from lateral movement is an array of rigid bars, having an interior and oriented vertically, the array of rigid bars enclosing the expanding conduit within the interior of the array, the array of rigid bars having space between the rigid bars sufficient to accommodate the exterior dimension of the tube exiting into the container interior.

* * * * *